US007000656B2

(12) United States Patent
Todd

(10) Patent No.: US 7,000,656 B2
(45) Date of Patent: Feb. 21, 2006

(54) DOSING SYSTEM

(75) Inventor: Jeffrey Todd, Leeds (GB)

(73) Assignee: Unilever Home and Personal Care USA Division of Conopco, Inc., Chicago, IL (US)

( * ) Notice: Subject to any disclaimer, the term of this patent is extended or adjusted under 35 U.S.C. 154(b) by 65 days.

(21) Appl. No.: 10/436,815

(22) Filed: May 13, 2003

(65) Prior Publication Data

US 2003/0213529 A1 Nov. 20, 2003

(30) Foreign Application Priority Data

May 17, 2002 (GB) ..... 0211419

(51) Int. Cl.
*B67C 3/00* (2006.01)

(52) U.S. Cl. ..... 141/180; 141/1; 141/94; 141/157; 141/168; 141/198; 141/285

(58) Field of Classification Search ..... 141/1, 141/94–96, 157, 165, 168, 180, 192, 198, 141/285, 286
See application file for complete search history.

(56) References Cited

U.S. PATENT DOCUMENTS

| | | | | |
|---|---|---|---|---|
| 1,959,694 A | | 5/1934 | Stevens | 226/97 |
| 3,887,110 A | * | 6/1975 | Porter | 222/16 |
| 4,083,389 A | * | 4/1978 | Rosen et al. | 141/179 |
| 4,226,266 A | | 10/1980 | Guigan | 141/11 |
| 4,348,162 A | | 9/1982 | Mancini | 417/431 |
| 4,868,051 A | | 9/1989 | Grosjean | 428/336 |
| 4,917,158 A | | 4/1990 | Lingenhoff | 141/258 |
| 5,417,260 A | | 5/1995 | Perrier | 141/146 |
| 5,899,244 A | * | 5/1999 | Nish et al. | 141/57 |
| 5,992,455 A | | 11/1999 | Koller et al. | 137/606 |
| 6,276,409 B1 | * | 8/2001 | Ellison | 141/234 |

FOREIGN PATENT DOCUMENTS

| | | |
|---|---|---|
| DE | 195 35 252 | 3/1997 |
| EP | 216 199 | 4/1987 |
| EP | 678 560 | 10/1995 |
| EP | 784 010 | 1/2000 |
| FR | 2 149 681 | 3/1973 |
| GB | 701 144 | 12/1953 |
| GB | 876 290 | 8/1961 |
| GB | 1 481 894 | 8/1977 |
| GB | 2 019 813 | 11/1979 |
| GB | 2 094 758 | 9/1982 |

OTHER PUBLICATIONS

PCT International Search Report in a PCT application PCT/EP 03/04411.
Derwent Abstract of DE 195 35 252 published Mar. 27, 1997.

* cited by examiner

*Primary Examiner*—Justine R. Yu
*Assistant Examiner*—Peter deVore
(74) *Attorney, Agent, or Firm*—Karen E. Klumas

(57) ABSTRACT

There are practical difficulties in dosing a component of a composition into its container, such as a personal care product into a hand-holdable dispenser on a filling line, due in part to the short time that is available for the operation. The difficulties can be ameliorated or overcome by employing dosing apparatus in which a metering pump feeds a flowable material such a liquid through a dosing nozzle positioned above a container intended to receive a charge, the nozzle having a plurality of individual spouts spaced apart from each other so as to prevent their individual streams coalescing and the spouts extending sufficiently below its support to prevent droplets from adjacent spouts coalescing.

22 Claims, 2 Drawing Sheets

DOSING SYSTEM

The present invention relates to a dosing system and in particular to a system for dosing a liquid into a container.

BACKGROUND AND PRIOR ART

The present invention is especially applicable to manufacturers of product that comprises a volume of a fluid composition dosed into a hand-holdable container. Without being prescriptive, the total volume of composition in such containers is typically between 5 and 1000 mls, though containers or either a larger or smaller volume may be contemplated, depending upon prevailing circumstances. The fluid compositions in such products normally contain one or more liquid components such as additives intended to impart a desirable characteristic to the composition. Many of these components or additives are each commonly present as a relatively small proportion of the overall composition, but for many reasons, it is desirable that it is dosed accurately into the composition. Some of the reasons are directly related to the nature of the component or additive, such as variation in product quality; for example if the additive is a fragrance, or a component of a fragrance, an incorrect dosage would alter the perceived smell of the product. Other reasons can have widespread applicability; for example many additives are relatively expensive, so that the total cost of the product can be increased inadvertently by even a small increase in the amount of additive added. The present invention is most desirably applicable in respect of dosing a component or only a small fraction of the composition into the container.

In one convenient method for manufacturers to fill containers or introduce one or more components into them, the container is conveyed to a filling station, is held there for long enough for filling and is thereafter removed to undergo a subsequent operation, such as capping or sealing the container. The maximum speed of a filling line is governed by the speed of the slowest operation which can have consequences as indicated below.

Apparatus has been described previously for conveying a fluid composition or component thereof into a container or onto the contents of a receptable through a nozzle in a dispensing head under pressure. Thus, for example, GB 2019813 describes a method and device for preparing beverages in portions, through two dispenser heads, possibly combined in a single unit, that are gently convergent. GB 2094758 describes related drinks apparatus in which two or possibly more nozzles direct jets of water at an acute angle into a cup to assist in the dissolution of a solid material, e.g. coffee or soup. GB 1481894 describes apparatus for the dispensing of syrup through a plurality of nozzles in a dispensing head onto an ice-cream substrate. EP 0216199 describes multi-orifice nozzle system having a variable pattern that is obtainable by independently oscillatable cylindrical cams, each bearing onto the cam surface of a needle valve to actuate or close the valve.

One method for making a product containing a fluid composition has been to prepare a large batch of the composition containing all its constituents in a vat and then withdraw a metered dose of that composition from the vat into the chosen container. This is a system that enjoyed widespread applicability because it is relatively simple to operate. It is relatively easy to mix large volumes of fluids to attain reasonable homogeneity and dose accuracy. Such a scale means that even comparatively small proportions of a constituent can be added quite accurately. For example, on a 10 tonne scale, 0.1% by weight constitutes 10 kg, which can be weighed quickly to an accuracy of better than 1%.

However, a batch manufacturing system is relatively inflexible to operate and includes a number of disadvantages that are becoming more applicable as consumers' habits and manufacturers' operational requirements change. There has been an increasing trend towards greater diversity in any single product, such as variations in the number of differently fragranced products offered to consumers to meet their individual preferences. Secondly, there is a trend for manufacturers to concentrate production at a smaller number of manufacturing sites. Both of these trends mean that there is a reduced likelihood that consecutive batches made in the same vat will have the same composition. When the composition of successive batches is different, it is necessary to clean out the vat and supply line to the filling station in order to avoid cross contamination between the two compositions. This can result in a significant down time between the production of the batches, and secondly there is a loss of the first composition which adhered to the vat wall and in the supply line. Both of these factors increase the average effective production cost of the manufacturer.

Accordingly, the instant inventor has been investigating how to reduce or circumvent the problems outlined above in batch manufacture. In one replacement method, the inventor contemplated introducing a liquid component of the composition directly into the eventual container. This, however, poses a different set of problems or difficulties. First, since the volume of composition to be introduced into a container is relatively small compared with the size of the batch, it is a significantly greater problem to dose an accurate weight of an individual component and especially an additive into the container compared with the entire batch. Secondly, dosing directly into the container can most easily be contemplated via a filling station on the filling line. The speed of the line dictates the length of the window whilst the container is under the filling station during which addition of the component can be carried out. Commonly, this is a relatively short period of time, often measured in fractions of a second. Though the window could be widened by moving the filling station at broadly the same speed as the line to keep both in register for longer, that in itself complicates the machinery, rendering it more expensive and introducing an extra risk of mechanical breakdown.

One method of dosing a measured amount of a liquid component comprises employing an accurate metering pump. Such pumps can be employed with a system in which a metered dose of the selected liquid component is expelled under pressure through a nozzle as a stream of liquid into a container that is held at a suitable orientation relative to the nozzle. These pumps are becoming more readily available, but their use is hindered by the fact that they have a relatively long response time. It is desirable to include sensing mechanism to detect the presence of a container at the dosing station in order to avoid wasteful discharge of the liquid component in the event that dosing and transport operations move out of synchronisation, especially in the context of fast line speeds and consequential short periods for dosing. Thus a slow response time of the pump can introduce considerable constraints on the line speed. Commonly, the speed of a dosing cycle is dictated by its slowest constituent element. Particularly in the case of dosing canisters, such as aerosol canisters, the use of an in-can dosing system based on such metering pumps would slow the filling line to such a great extent that the employment of such a system could not be countenanced commercially. The need remains to find a means to enable such accurate metering pumps to be employed.

In the course of the investigations leading to the instant invention, the inventor contemplated several modifications to the dosing system including increasing the pressure on fluid expelled through the nozzle, widening the nozzle diameter and inserting a mesh within the nozzle. Increasing the pressure on the liquid to the extent needed to compensate for the slow response time of the metering pump increases the linear velocity of the liquid to such an extent that it tends to break up the liquid into droplets when it encounters the base and/or side of the container into which it is being dosed, significantly increasing the risk that a variable fraction of the liquid will escape. This defeats the benefit achievable using an accurate metering pump.

A second possible variation comprises widening the nozzle, and at face value this would be attractive, because it would widen the diameter of the stream of liquid and thereby could permit a greater flow rate without significantly increasing the linear velocity of the flow. Unfortunately, this also was found to result in a reduction in the accuracy of dosing the liquid. Two causes of inaccuracy were identified, though there may be others. First, the use of a wider nozzle altered the overall shape of the stream, producing a longer tail after the control valve has been closed. In a tail, the diameter of the stream has become narrowed so that the volume flow is markedly reduced compared with that prevailing when the valve is open. Secondly, a wider nozzle encouraged the entrainment of bubbles of gas within the liquid and the formation of latent drips from the tip of the nozzle that continued noticeably after the control valve was closed. In an attempt to ameliorate this problem, the inventor inserted a mesh within the widened nozzle, but instead of curing the problem, in some ways the mesh even made it worse. The mesh actually increased to tail. Accordingly, the problem still remained as to how to accommodate a metering pump with a long response time.

It will be recognised that none of the patent specifications mentioned above contemplate or address such a problem.

It is an object of the present invention to identify a process and apparatus that can overcome or ameliorate one or more of the problems identified hereinbefore to improve in-container dosing of a liquid component into a container.

It is a further object of certain preferred embodiments of the present invention to improve the dosing of a small volume of liquid into a dispensing container on a high speed filling line.

SUMMARY AND BRIEF DESCRIPTION OF THE PRESENT INVENTION

In accordance with one aspect of the present invention there is provided a process for introducing a dose of a liquid component into a container having an open mouth comprising the steps of:

conveying the container to a dosing station, retaining the container within the dosing station whilst the dose is introduced into the container and thereafter conveying the container away from the dosing station, which station comprises a retaining means for the container, a dosing head positioned above the retaining means and housing a dosing nozzle oriented downwardly towards the mouth of container, the retaining means enabling the nozzle to remain in register with the mouth of the container for a preset period of time, an inlet line for the liquid component terminating in the nozzle, and a metering pump mounted within the inlet line;

actuating the metering pump when the container is retained at the dosing station, thereby expelling the liquid component through the filling nozzle in a stream for the pre-set period of time;

in which process the nozzle is employed in the form of an assembly of individual spouts depending from a support, each of which is spaced from an adjacent spout such that streams of liquid expelled through adjacent individual spouts do not coalesce together, each individual spout projecting beneath the support for such a depth that formation of a droplet by coalescence of liquid between adjacent nozzle tips is hindered or prevented.

In accordance with a second aspect of the present invention there is provided an apparatus for introducing a determined volume of a liquid component into a container having an open mouth comprising:

a dosing station which can be located above a conveyor that conveys the container sequential towards and then away from the station, which station comprises:

a retaining means for the container, a dosing head positioned above the retaining means and housing a dosing nozzle oriented downwardly towards the mouth of container, the retaining means enabling the nozzle to remain in register with the mouth of the container for a preset period of time, an inlet line for the liquid component terminating in the nozzle, and a metering pump mounted within the inlet line, a control means for actuating the metering pump when the container is positioned at the dosing station, a means to expel the liquid through the dosing nozzle in the form of a stream in which apparatus the nozzle is employed in the form of an assembly of individual spouts depending from a support, each of which is spaced from an adjacent spout such that streams of liquid expelled through adjacent individual spouts do not coalesce together, each individual spout projecting beneath the support for such a depth that formation of a droplet by coalescence of liquid between adjacent spout tips is hindered or prevented.

By employing a multiplicity of spouts that each project to such a depth that droplets do not form between them by coalescence, and spaced apart at such a spacing that the individual streams do not coalesce, it becomes possible to employ an accurate metering pump without encountering the disadvantages of a stream having the extended tail and the enhanced risk of drips that would arise from using a single nozzle of the same cross sectional as that in total of the multiplicity of streams. If the multiplicity of spouts were spaced closer together, they would coalesce and thereby regenerate a single stream and recreate the extended tail. If the individual spouts did not project significantly below the support, but, for example, each outlet terminated in a flat face, the risk would be greatly increased of small droplets at the end of each spout adhering to the face of the support between the outlets, thereby enabling a larger droplet to be formed with a concomitantly increased risk of the droplet becoming detached from nozzle on account of its increased weight.

Whilst this invention is particularly suitable for introducing a small amount of a liquid into a container, for example a dispensing container of a personal care product, with the intention of completing the composition within the container, it will be recognised that the same technique can be employed for introducing a metered volume of a liquid component that constitutes even a major fraction of the eventual final composition. Although the invention is especially suitable for introducing a component of a composition that is intended for distribution and sale in the container into which it has been introduced, it will be recognised that the invention is also suitable for employment during analytical procedures which desire to introduce accurately measured volumes of an analytical reagent and/or a sample into a chamber in which analysis can subsequently be carried out.

DETAILED DESCRIPTION OF THE INVENTION AND PREFERRED EMBODIMENTS THEREOF

The present invention relates to apparatus and a process for accurately dosing a volume of liquid, and particularly a small volume of liquid into a container for eventual sale or further processing. The container is often intended to be held in the hand. In particular, the container usually has a relatively narrow mouth, described in more detail below, through which it is filled. Essential constituents comprise an accurate metering pump and a nozzle with a multiplicity of spouts that are spaced to prevent coalescence of the individual streams from each spout and are proud of a support to hinder or prevent droplet coalescence.

The present invention will be described herein with reference in particular to the manufacture of a composition for eventual sale. The invention is suitable for the introduction of additives into a container for mixing with a bulk formulation (in some circumstances alternatively called a master-batch) containing the remaining components of the composition. In that way, it is possible to make and/or store batches consisting of the greater fraction of any particular composition which are the same from one batch to the next, avoiding the loss of product and down-time required to clean the manufacture or storage vat between batches. Variants are easily obtained by introducing different additives withdrawn from individual storage containers, which may even be the containers in which the additive is distributed to the composition manufacturer. It is even possible to contemplate continuous or semi-continuous manufacturing processes for the bulk formulation, on account of the improved capability to vary the addition of different additives that the instant invention offers.

The range of additive or other liquid components for which the instant invention is applicable is any liquid that can be pumped. The additive can itself be liquid under the prevailing conditions or have been rendered liquid by dissolution or dispersion in a suitable solvent or carrier fluid. Commonly, the component may be liquid or liquified at ambient temperature, though the invention is applicable if desired to materials which have become liquid at an elevated temperature, e.g. up to 100° C. The choice of the liquid component will vary depending on the nature or intended use of the composition. Such liquid components can be selected from a non-exhaustive list comprising:

liquid abrasives; acidifying agents; analgesic; anti-acne agents; caking or anti-caking agents; anticaries agents; antidandruff agents; antifoaming or foaming agents; antifungal agents or fungicides; antimicrobial agents or microbicides; antioxidants; antiperspirants; antistatic agents; basifying agents; buffering agents; liquid bulking agents or diluents; chelants; colorants or dyes; corrosion inhibitors; cosmetic additives; denaturants; deodorants; depilating; or epilating agents; drugs; emulsifiers; emulsion stabilisers; externally applied analgesics; film formers; flavourings; fragrances; colorants, conditioning agents, fixatives, waving or straightening agents or bleaches for hair; hair growth promotion agents; humectants or moisturising agents; lytic agents; nail conditioning agents; neutralising agents; opacifying agent; oral care agents; oral health care drugs; oxidising agents; pH adjusting agents; pharmaceutically active ingredient; plasticisers; preservatives; prophylactics; reducing agents; skin bleaches; skin conditioners; skin protectants; slip modifiers; solvents or carrier fluids; sunscreen agents; surface modifiers; surfactants or solubilising agents, including hydrotropes; stabilisers; suspending agents; therapeutic drugs; ultra violet light absorbers; viscosity controlling or modifying agents. Where the invention is employed in conjunction with analysis, the liquid component can comprise either the sample itself or a reagent or diluent which needs to introduced in a fixed volume ratio to the sample.

Without being prescriptive, the invention is suitable for employing during the course of manufacture of personal care products, including both cosmetic and pharmaceutical products, such as deodorant or antiperspirant products, body sprays, oral care products, hair care products, medicaments, skin care products, including moisturisers, anti-ageing and sunscreen products, therapeutic products including analgesics that are applied topically, and therapeutic agents that are sprayed into the buccal cavity. The instant invention can also be employed for the introduction of a liquid component into fluid domestic or industrial products, such as pesticides, cleansing agents, detergent formulations inter alia for fabric washing, or hard surface cleansing or disinfection and indeed to any fluid product containing a fragrance, preservative or minor amount of an additive from the list given hereinabove. The eventual form of the composition in the product is normally fluid, that is to say flows under the prevailing conditions. It may be a simple liquid or may be in admixture with a propellant such as liquidised gaseous hydrocarbons or compressed air, nitrogen or inert gas.

The container into which the additive or other liquid component can be introduced in accordance with the present invention can have flexible or inflexible walls and can comprise a bottle, jar, can or canister, dispenser, phial, ampoule, pouch, sachet, sample chamber or other receptacle for a liquid, provided that it has an open mouth dimensioned to permit passage therethrough of the stream of the liquid component.

In operating the instant invention, the liquid component is withdrawn from its supply tank under the control of the metering pump. The metering pump preferably comprises a ceramic metering pump in which a ceramic piston slides within a cylindrical chamber within a ceramic block. More preferably, the inlet and outlet to the chamber are diametrically offset from each other and the piston has an helical groove having a similar width to the diameter of the inlet and outlet extending part way down from its interior face, the piston being rotated during the dispensing cycle so that as the piston moves down in the first half increasing the volume of the chamber, the piston closes the outlet and the inlet exposed and for a fraction of the first half, the groove is in register with the inlet and, whereas when the piston moves up, the inlet is closed by the piston and the outlet is exposed, being for a fraction of the second half in register with the groove. The volume of fluid dispensed by the pump is proportionate to the stroke of the piston that is adjustable by the user so as to vary the volume of fluid dispensed at each stroke.

Most conveniently, the capacity of the metering pump is selected in conjunction with the volume of the component that it is intended to dose into the container, so that it can be dosed by a single cycle, i.e. with a single stroke. When one cycle is complete, the pump is reset for actuation to dose a further volume of the fluid component into the next container. However, for dosing larger volumes, a plurality of pump cycles can be contemplated by suitable control of the pump, for example by employing a control mechanism that permits a presettable number of cycles or operation for a presettable length of time that corresponds to the desired number of cycles. Although the pump has been described in respect of a single headed pump, it will be recognised that double headed pumps could be contemplated as an alternative in order to pump twice the volume of the same component or two different components simultaneously into the same container, though where different components are dosed simultaneously, they are either mixed in the dosing head upstream of the dosing nozzle or two nozzles are employed side by side with combined dimensions that are preferably in accord with the dimensions relative to the mouth of the container described herein for a single nozzle.

The metering pump can be actuated under the control of a simple timer. At its simplest, the timer can not only control how long the pump is dispensing the liquid component, but can also control when actuation of the pump commences. In such operation, the operator not only presets the length of time that the pump is in operation during each cycle, but additionally presents the interval of time when the pump is not operating, the size of the interval commonly being dictated by the speed of the line determining the cycle time and hence the residue of the cycle time less the operational period. The duration of the pump operation dictates how much liquid component is dosed into the container.

However, it is especially preferable if the timing of pump actuation is supplemented by as a check or alternatively in preferred embodiments is controlled by a sensor recognising when the container into which liquid is going to be dosed is positioned at the dosing station. In the absence of such a sensor, there is a risk that the position of and removal of the container from the dosing station could cease to be properly synchronised with the expelling of liquid through the nozzle, with consequential miss-filling of the container line. The sensor can comprise any one of a number of different types of sensor, such as a pressure detector on the retaining means or possibly a pressure pad under the conveyor backward of the retaining means, or a sensor in which an infra-red or light beam is interrupted by the container or possibly a sonic signal is reflected. In practice, it is preferable to employ a sensor that employs a light beam or similar radiation because of its sensitivity and speed of response.

The metering pump is often in operation during each dosing cycle for a period of from 3 to 1000 milliseconds. The shorter dosing period tends to correspond to a single pump cycle, often from 3 to 15 milliseconds, whereas longer dosing periods tend to correspond to multiple pump cycle dosing. However, for many metering pumps and in particular for the preferred ceramic metering pumps identified above, the response time of the pump to an actuating signal is between 75 and 120 seconds.

The period of time when the container can be kept at the dosing station is dictated to a great extent by the speed at which the filling line is being operated. It is often of practical and commercial benefit to be able to operate a filling line at as fast a rate as possible, because it reduces the capital cost per unit and hence overall processing cost per unit. However, as the speed of the line increases, then the window for dosing any particular component into each container proportionately decreases.

Although the period at the dosing station is at the discretion of the manufacturer, in operations according to the instant invention, such a period is often not longer than 5 seconds, though it could be. The invention is particularly well suited to very short dosing station periods, such as dwell periods of up to 1 second, often up to 500 milliseconds, thereby enabling the filling line to be operated at a rapid rate. The minimum period at the dosing station is in practice often determined to a considerable extent by aggregating the individual times for three activities, namely an initial period for sensing the presence of the container at the dosing station and causing the pump to commence pumping, secondly the time during which the component is dosed into the container and thirdly preferably a post-dosing safety period to allow for any residual drips to drip from the nozzle into the container. Commonly it takes at least 20 milliseconds to sense the presence of the container and actuate the pump and for at least some pumps, from 40 to 80 milliseconds. A practical dosing time is often at least 3 milliseconds. The post-dosing period is desirably at least 5 milliseconds and in many instances from 15 to 100 milliseconds, such as from 45 to 75 milliseconds. In consequence, a convenient minimum dosing station period is usually at least 40 milliseconds and for many pumps is at least 60 milliseconds, and for others sometimes 100 milliseconds.

In many instances, the dosing station period employed in the instant invention process is at least 80 milliseconds and for some a preferred period of between 120 and 300 milliseconds. It will, however, be recognised that such a preferred period is employable when it is desired to dose a small volume of the liquid component into each container, such as from 0.1 to 2 mls of liquid per container. Dwell periods of up to 1 second can readily accommodate liquid dosing of approaching 10 mls per container. As the volume of liquid dosed into each container is larger, so the proportion of the dosing station period devoted to sensing and post dosing diminishes.

The present invention is well suited to dosing a component or a small fraction of total composition into a small container, commonly a dispensing container and particularly a container with a small mouth, on a high speed filling line.

The instant invention is especially well suited to dosing containers with a small volume of liquid, such as from 0.1 to 2 mls per container when the dwell time is constrained by the need to operate fast filling line speeds to a period between 120 and 500 milliseconds.

The dosing nozzle has a multiplicity of spouts, each spout preferably having an aperture of substantially circular transverse cross section so as to generate a cylindrical stream which may, at least initially and/or terminally taper. In conjunction with the overall diameter of the nozzle, both the diameter of the aperture in each spout and number of spouts is variable at the discretion of the manufacturer, who will normally take into account the volume of liquid component that is to be dosed, and especially the dimensions of the mouth of the container.

The spacing between the spouts is desirably at least 0.5 mm and especially is at least 1 mm, a spacing being the minimum distance between the sidewall at the tip of a pair of adjoining spouts measured on the line extending between the respective centre of each spout. It will be recognised that the main consequence of employing a wider spacing is to restrict the number of spouts that can be accommodated within a nozzle of a specified overall diameter. Thus, although a spacing of up to 4 mm could be contemplated, and particularly for wide nozzles, the spacing is usually not greater than 3 mm and particularly from 2 to 3 mm. Accordingly, in qualitative terms, the spouts are desirably located close to each other, though not so close as to permit coalescence of the individual narrow streams from the spouts.

In practice, the overall diameter of the nozzle is preferably at least between 1 and 5 mm less than the diameter of the mouth, to some extent depending on the vertical spacing between the nozzle and the mouth. Commonly, the nozzle is up to ¾$^{rs}$ the diameter of the mouth and in many instances between ¼ and ⅔$^{rds}$. The mouth dimensions naturally vary in accordance with the shape of the container. In most instances, the mouth will have a diameter of from 5 to 100 mm and in many instances the mouth diameter is at least 10 mm and often in the range of from 15 to 35 mm. The diameter of the nozzle for use in conjunction with a mouth of from 15 to 35 mm is often from 9 to 12 mm.

The number of spouts in practice is selected in conjunction with the overall diameter of the nozzle. Commonly, the nozzle contains at least 3 spouts, often at least 4 spouts and in many instances at least 7 spouts. The number of spouts is, in many desirable nozzles not more than 32 and a number of eminently suitable nozzles comprise up to 25 spouts. For many desirable nozzles, the number of spouts, n, falls approximately within the range of $n^1$ to $n''$ in accordance the formula $n^1=d^2/10$ and $n''=d^2/8$, where d is the diameter of the nozzle in mm and the number of spouts is rounded down for $n^1$ and rounded up for $n''$. The spouts are preferably disposed in a symmetrical array, more preferably in the form of a circle or a series of concentric circles when 4 or more spouts are employed, a central spout being deemed to constitute the innermost circle, if it is employed. Some suitable arrays comprise a 7 spot pattern comprising a central spout and 6 symmetrically disposed spouts in a circle centred on the spout. Other suitable arrays comprise 1, 3 and 6 spouts totalling 10 in a central spout and two concentric circles, 1, 4 and 8, totalling 13, 1, 5 and 10 totalling 16. and 1, 6, 12 totalling 19. For a larger diameter nozzle, a suitable array can comprise 1, 4, 8 and 12 totalling 25.

Herein, the spout aperture diameter is commonly selected in the range of from 0.8 to 3 mm and particularly from 1 to 2 mm. It will be recognised from the foregoing that the instant invention is especially suitable for dosing a fragrance or other minor ingredient in liquid form into an aerosol canister or a roll-on dispenser.

Each spout may be the same depth proud of the support, or may be at different depths, such as each circle being at a different depth from that of spouts in an adjacent concentric circle, or/and adjacent spouts around a circle may have different depths from the support. Thus two alternative dispositions can comprise all the spouts having the same depth or the central spout having the greatest depth with the spouts in succeeding concentric circles having successively shorter depths. The depth of each spout is desirably at least 3 mm and preferably at least 4 mm. In many instances the spout depth is no greater than 20 mm and particularly up to 10 mm.

In a particularly desirable arrangement, the spouts can be arranged to be parallel with each other. As an alternative, it is possible for them to be inclined at a very small divergent angle, such as from 0.5 to 2 degrees. The extent of divergence is in practice often constrained by the respective diameters of the nozzle and container mouth and the height of the nozzle above the mouth, as would be recognised and understood by the skilled person. Convergence of the spouts is to be avoided.

It is preferable for the stream (which consists of a plurality of individual non-coalesced narrow streams) to be directed perpendicularly through the container mouth onto its base, although the stream may be inclined at a small acute angle to thereto, such as an angle selected between 1 and 5 degrees.

As a check, it is often desirable to employ a check mechanism to confirm whether or not the liquid component is being dosed into the container. The check mechanism can comprise a laser beam or other narrow beam whose path is interrupted by the streams of liquid being expelled through the nozzle. The laser can conveniently comprise a flat beam scanning laser. The output from the scanning laser's detector, i.e. dose or no dose, can be compared with the output from the container sensor. In the event that the laser mechanism should fail to detect a dose before the container sensor registers the presence of a following container, the comparator (a not gate) can generate a signal which can itself be employed in a number of ways. In one way, the signal can actuate a mechanism to remove the container to a reject line instead of permitting the container to remain on the normal filling line. In a second way, the signal can actuate a recording or display mechanism for example via a computer, which records the numbers that fail, or warns the operator or control device that a failure has occurred. The numbers of failures can be counted and compared with the number of containers dosed, for each calculating the number of failures in a rolling 1000 containers passing through the dosing station. If the number approaches or exceeds a predetermined threshold, a further signal can be generated to warn the operator so that remedial action could be taken.

Preferably, the dosing nozzle spout tips in the dispensing head are positioned at a height of from 12 to 50 mm above the mouth of the container, and particularly between 15 and 25 mm. Such a spacing between dosing head and container provides a sufficient spacing to allow for intermediate scanning by the laser without introducing greater risks or uncertainties arising from a larger spacing.

The invention is described herein with regard to the dosing of one liquid component into the container, but it will be understood that it can be repeated using a further set of apparatus to introduce a further stream, which may be carried simultaneously with or subsequent to the first stream. The number of simultaneous streams is preferably chosen in conjunction with the diameter of each relative to the diameter of the mouth so as to avoid them colliding with each other or spilling outside the mouth.

The dosing of liquid component according to the present invention may be introduced into an empty container or one which already contains one or more of the remaining components of the composition, for example introduced at an earlier filling station upstream in the filling line.

The container can be desirably brought into register with the nozzle on a conveyor belt, preferably adapted to decelerate the movement of the can, bring it to a halt for a predetermined length of time, maintain it stationary for the dosing period referred to hereinabove, and thereafter accelerate the can out of register. This can be achieved relatively conveniently by a pair of eccentrically mounted rotating vertical rollers mounted across the conveyor on the downstream side of the dosing station. The two rollers each rotate in synchrony about its vertical axis, and the axes are spaced apart such that sequentially during each rotation, the faces of the rollers are closer than the diameter of the container such that the container is held against the rollers by friction between its base and the conveyor, continued rotation of the rollers maintains the spacing between the rollers less than the container diameter until near the end of the rotation, the spacing widens to greater than the container diameter, permitting it to pass through. Further rotation of the rollers bring them back to the starting position for a subsequent container. It will recognised that there is one revolution of the roller per container, so that for example, if the line speed of the conveyor is 5 containers per second, then the roller rotates likewise at 5 revolutions per second. Although this is described for twin rollers, a similar effect can be achieved with a single, eccentrically mounted vertically rotating roller acting together with an opposed stationary wall or by a transversely reciprocating cam and opposed stationary wall or pair or reciprocating cams.

An alternative container retaining means can comprise a rotating scroll that is mounted in the longitudinal direction above the conveyor and its surface at a height at which it can come into contact with the container, preferably in the vicinity of its centre of gravity, so as to minimise any risk of the container being toppled over. The scroll comprises a rod into which is formed a helical thread that is dimensioned to receive the container. For a circular container, the thread profile is preferably semicircular, and for other cross-section shapes, a corresponding profile can be provided or alternatively for regular polygonal shapes, a semicircular thread profile can be suitable too. The container is conveyed into the open end of the thread by the conveyor, optionally with the assistance of a baffle. The scroll is rotated to drive the helical thread to counter the movement of the conveyor. Advantageously, the pitch of the thread is varied along its length. Initially, it preferably has a comparatively large pitch, which is decreased to decelerate the container until when the container is in register with the dosing nozzle, the pitch is small, thereby causing the container to dwell at that point at the dosing station, and thereafter the pitch of the thread is increased to enable the container to accelerate until the container reaches the remote (downstream) end of the helical thread, preferably at the speed of the conveyor. Advantageously, the scroll provides one revolution of the scroll in the central dwell section within minimum pitch. The container thereafter is able to exit from the scroll and be conveyed away from the dosing station by the conveyor. It will be recognised that the scroll can accommodate three containers at any one time, one decelerating, one in the dwell position in register with the dosing nozzle and one accelerating away from the dosing station.

Once the chosen component or compositor has been dosed into the container, the latter is conveyed away from the dosing station for subsequent operations, which may include the introduction of one or more further components. A further subsequent operation which can be employed when the container itself comprises a dispenser of a compositor, such as one of the types of compositions named hereinbefore, is that of closing or sealing of the mouth of the container, for example by applying a closure over or inserting it into the mouth or squeezing the mouth side-walls together and heat sealing or gluing them. The closure may be removeable to permit the user to extract the contents of the container or can act as a dispensing element. Such an element can comprise a valve and actuator for an aerosol, a pump mechanism for a pump dispenser, eg a pump spray, a roller (often a roll ball) and a housing therefor for a roll on dispenser, a perforated or apertured plug for topical application of a liquid or cream/soft solid. If desired, such dispensing element may itself be covered by a protective cover or other form of packaging in a yet further subsequent operation.

Where the container is being employed in analysis, such as in high speed automatic analytical equipment, a subsequent and/or prior operation can comprise the introduction of a further reagent and the sample to be analysed, and a later operation comprises a detection stage in which a detectable property or change in the property of the sample is measured or observed and recorded.

The process and apparatus herein has been described particularly with regard to the dosing of a liquid into a container, but it will be recognised that the liquid is representative of a non-gaseous flowable substance, i.e. a material which flows when subjected to modest pressure, typically less than about 1 bar, including flowable liquids having an increased viscosity, flowable gels and powders.

Having described the invention in general terms, a specific embodiment thereof is described hereinafter in more detail by way of example only with reference to the accompanying drawings in which.

The apparatus comprises a supply tank [1] for a liquid fragrance composition [2] which linked by a supply line [3] via a ceramic metering pump [4] to a dosing nozzle [5] in a dosing head [6]. The metering pump [4] is model 092117 of adjustable stroke which comprises a single ended heavy duty motor base/module with a split case pump head from Ivec Corporation, the piston rotating through 360° during each cycle. Nozzle [5] comprises thirteen parallel spouts [7], from each of which is expelled a parallel stream of liquid [8] when metering pump [4] is pumping. An aerosol can [9] having a mouth [10] having a diameter that is about 2.2 times the diameter of the nozzle [5] is positioned about 11 cm perpendicularly below nozzle [5]. A light beam sensor for the can [9] comprising an emitter [11] and detector [12] is positioned beside the can and is linked electronically to an actuating mechanism (not shown separately) of the pump [4], a signal being generated by the detector [12] when the light beam is interrupted and transmitted to actuate the opening of the pump when can [9] is sensed to be below the nozzle [5]. A laser beam emitter [13] is positioned intermediate between the nozzle [5] and mouth [10] and generates a parallel beam of light which is intercepted by one or more of streams [8] and the resultant shadow is detected by detector [14] to confirm the passage of a dose of the liquid towards the container [9]. The detectors [12 and 14] are each arranged to generate and transmit a signal to a comparator [15] if respectively a can or dose is detected, and if no dose is detected within a predetermined period time corresponding to one dosing cycle, the comparator can alert an operator or actuate a reject mechanism (not illustrated).

A conveyor belt [16] brings the can [9] into abutment with a container retaining means which comprises a rotating scroll [17] which is positioned above the conveyor [16] facing upstream at a height including the centre of gravity of the can [9]. The scroll [17] comprises a rod [25] which can be rotated by a motor (not illustrated) into which is formed a helical thread having a variable pitch along the length of the rod [25]. The pitch becomes progressively smaller until it attains its minimum when the container is in register with the dosing nozzle [5] for just less than one revolution and thereafter increases. The thread [26] is semicircular in profile and dimensioned so as to accommodate the can [9]. The can [9] enters the upstream end of the thread [26] under the influence of the conveyor 16, and by rotating the scroll [17] the can [9] is retained within the dosing station until it reaches the downstream end of the thread [26] whereupon it is released from the scroll and conveyed away by conveyor [16].

Figure 1:
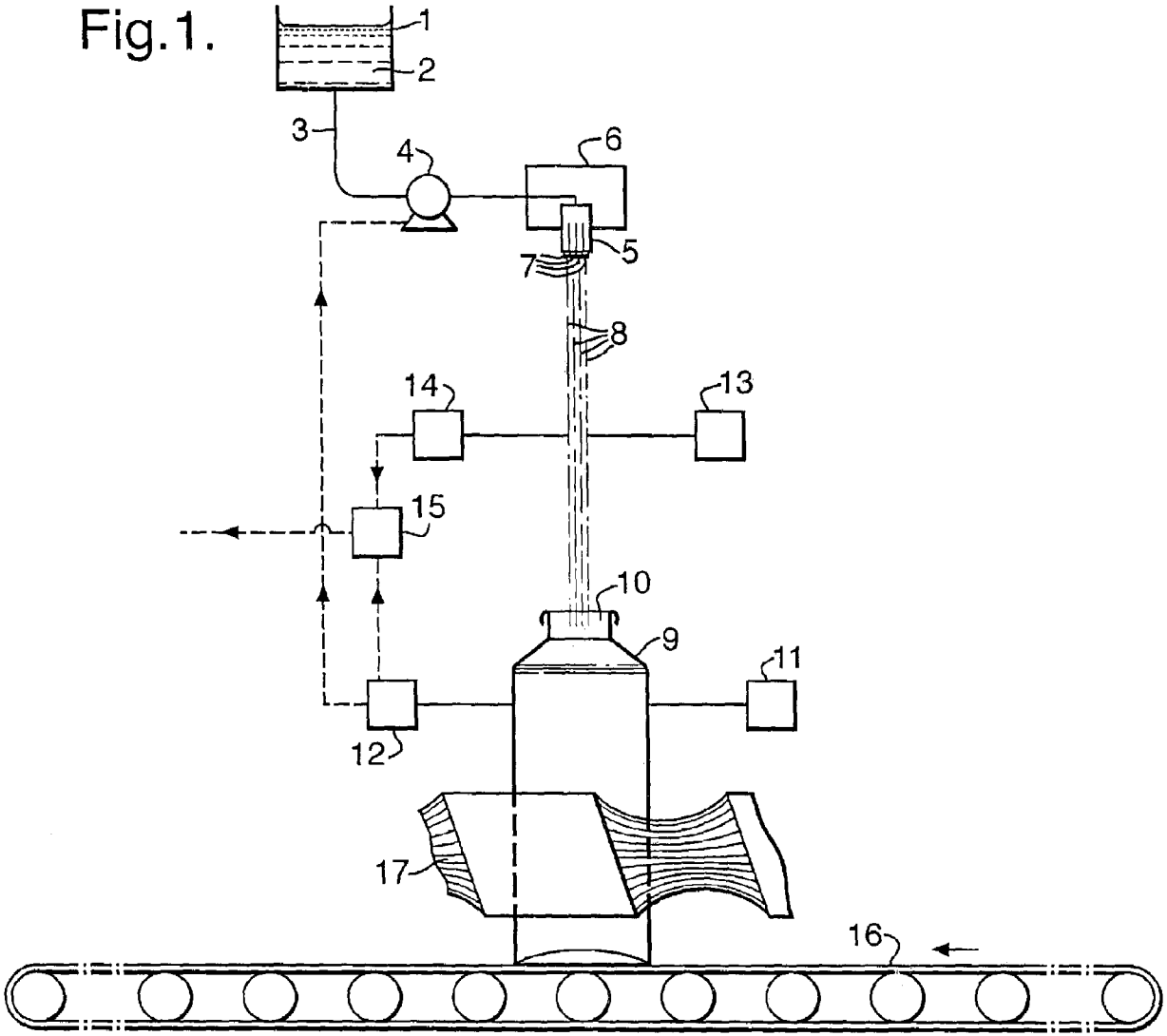
FIG. 1 represents a schematic diagram of the apparatus
Figure 2:
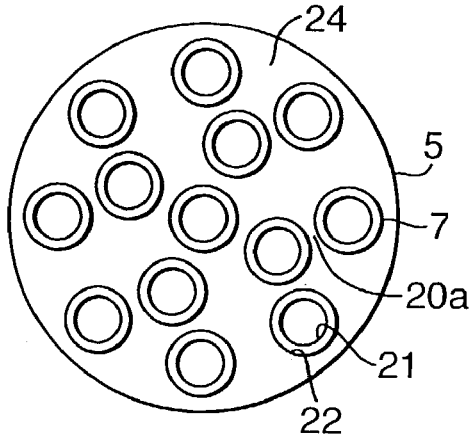
FIG. 2 represents a bottom plan view of the multi-spout nozzle in FIG. 1.
Figure 3:
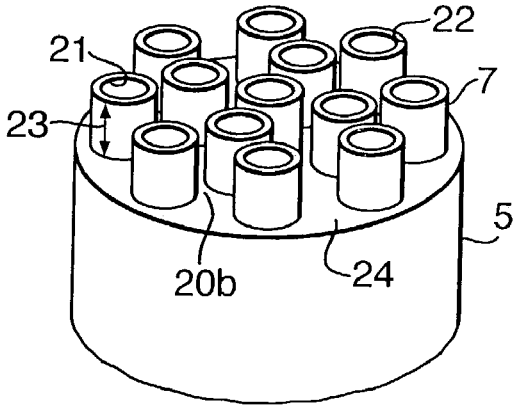
FIG. 3 represents a three-quarter side view of the nozzle of FIG. 2.
Figure 4:
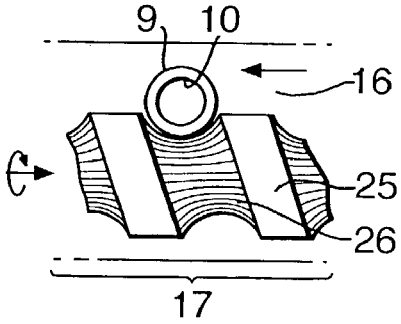
FIG. 4 represents a schematic plan view of the can retaining means with can in place.

The multi-spout nozzle [5] shown in greater detail in FIGS. 2 and 3 has an external diameter of 11 mm and comprises 13 individual stainless steel spouts [7] each of which has a depth of approximately 5 mm [23] which depend from a flat support surface [24], a wall [22] defining an outlet aperture of diameter approximately 1.2 mm and spaced from adjoining spouts in the region of about 2 to 3 mm[20*a,* 20*b]*. The spouts [7] are parallel.

In operation, the filling line is run at a speed of almost 6 cans per second, so that the cycle time to complete the dosing is approximately 170 milliseconds. The first period of 90 milliseconds provides for can detection and the response time of the metering pump of approximately 75 milliseconds. The pump then operates for a single cycle which lasts approximately 7 milliseconds to dose 1.5 mls of liquid fragrance into each can providing a subsequent safety window of 63 milliseconds to allow for the passage of the fluid into the can, a post-dosing window and for the can to be dismounted from the dosing station. The process enable accurate dosing of the fragrance into the can at a fast line speed.

Although the invention is exemplified in respect of dosing a fragrance into a can, the same apparatus can be employed to similarly dose other liquid additives or composition components into any other container, the retaining means, be it scroll or otherwise, being process engineered to enable to container to be held in a suitably upright position with its mouth facing the nozzle, if necessary with its side-wall supported if it is flexible.

What is claimed is:

1. A process for introducing a dose of a liquid component into a container having an open mouth comprising the steps of:

conveying the container to a dosing station, retaining the container within the dosing station whilst the dose is introduced into the container and thereafter conveying the container away from the dosing station, which station comprises a retaining means for the container, a dosing head positioned above the retaining means and housing a dosing nozzle oriented downwardly towards the mouth of container, the retaining means enabling the nozzle to remain in register with the mouth of the container for a preset period of time, an inlet line for the liquid component terminating in the nozzle, and a metering pump mounted within the inlet line;

actuating the metering pump when the container is retained at the dosing station, thereby expelling the liquid component through the filling nozzle in a stream for the pre-set period of time;

in which process the nozzle is employed in the form of an assembly of individual spouts depending from a support, each of which is spaced from an adjacent spout such that streams of liquid expelled through adjacent individual spouts do not coalesce together, each individual spout projecting beneath the support for such a depth that formation of a droplet by coalescence of liquid between adjacent nozzle tips is hindered or prevented; and wherein the nozzle is outside the mouth of the container as the dose of liquid component is introduced into the container.

2. A process according to claim 1 wherein the container is retained at the dosing station for a period of from 40 to 500 milliseconds.

3. A process according to claim 2 wherein the container is retained at the dosing station for a period of from 100 to 300 milliseconds.

4. A process according to claim 1 wherein the container is retained at the dosing station for a period of from 10 to 100 milliseconds and preferably from 30 to 80 milliseconds after the dose of fluid has been dispensed.

5. A process according to claim 1 wherein from 0.1 to 2 mls of fluid component is dosed into each container.

6. A process according to claim 1 wherein the presence of the container at the dosing station is detected by the container interrupting a light beam.

7. A process according to claim 6 wherein the interruption of the beam by the container actuates the metering pump.

8. A process according to claim 1 wherein dispensing of the dose of fluid is detected by a scanning laser.

9. A process according to claim 1 in which the container into which a dose is to be dispensed has a mouth of from 15 to 35 mm diameter.

10. Apparatus for introducing a determined volume of a liquid component into a container having an open mouth comprising:

a dosing station which can be located above a conveyor that conveys the container sequential towards and then away from the station, which station comprises a retaining means for the container, a dosing head positioned above the retaining means and housing a dosing nozzle oriented downwardly towards and above the mouth of container, the retaining means enabling the nozzle to remain in register with the mouth of the container for a preset period of time, an inlet line for the liquid component terminating in the nozzle, and a metering pump mounted within the inlet line, a control means for actuating the metering pump when the container is positioned at the dosing station, a means to expel the liquid through the dosing nozzle in the form of a stream in which apparatus the nozzle is employed in the form of an assembly of individual spouts depending from a support, each of which is spaced from an adjacent spout such that streams of liquid expelled through adjacent individual spouts located above the mouth of the container do not coalesce together, each individual spout projecting beneath the support for such a depth that formation of a droplet by coalescence of liquid between adjacent spout tips is hindered or prevented.

11. A process according to claim 1 wherein the nozzle employing from 3 to 32 spouts.

12. A process according to claim 11 wherein the nozzle comprises from 7 to 20 spouts.

13. A process for introducing a dose of a liguid component into a container having an open mouth comprising the steps of:

conveying the container to a dosing station.

retaining the container within the dosing station whilst the dose is introduced into the container and thereafter conveying the container away from the dosing station. which station comprises a retaining means for the container, a dosing head positioned above the retaining means and housing a dosing nozzle oriented downwardly towards the mouth of container, the retaining means enabling the nozzle to remain in register with the mouth of the container for a preset period of time, an inlet line for the liguid component terminating in the nozzle, and a metering pump mounted within the inlet line;

actuating the metering pump when the container is retained at the dosing station, thereby expelling the liguid component through the filling nozzle in a stream for the pre-set period of time; in which process the nozzle is employed in the form of an assembly of individual spouts depending from a support, each of which is spaced from an adjacent spout such that streams of liguid expelled through adjacent individual spouts do not coalesce together, each individual spout projecting beneath the support for such a depth that formation of a droplet by coalescence of liguid between adjacent nozzle tips is hindered or prevented; wherein the spouts are arranged in concentric circles.

14. A process according to claim 13 wherein the nozzle employs three concentric circles.

15. A process according to claim 1 wherein the spouts are spaced adjoining spouts by from 1.5 to 4 mm and preferably from 2 to 3 mm.

16. A process according to claim 1 wherein the spouts have an aperture diameter of from 1 to 4 mm.

17. A process according to claim 1 wherein the spouts have a depth below a support plate of at least 3 mm and preferably from 4 to 10 mm.

18. A process according to claim 1 wherein the nozzle has a diameter that is from ¼ to ⅔$^{rds}$ the diameter of the mouth of the container into which the fluid component is to be dosed.

19. A process according to claim 1 wherein the nozzle is positioned at a height of from 5 to 20 cm above the mouth of the container into which the fluid component is to be dosed, and preferably from 8 to 14 cms.

20. A process according to claim 1 wherein the metering pump is a ceramic metering pump.

21. A process according to claim 20 wherein the metering pump has a response time of from 20 to 100 milliseconds.

22. A process according to claim 20 wherein the metering pump doses the fluid component into the container during a period of from 5 to 100 milliseconds.

* * * * *